United States Patent [19]

Merten et al.

[11] 4,286,823

[45] Sep. 1, 1981

[54] CONVEYOR AND GUIDE ASSEMBLY

[75] Inventors: Gerhard Merten, Lunen; Wolfgang Peters, Selm; Hans-Dieter Schneider, Lunen; Willy Heyer, Bochum-Gerthe, all of Fed. Rep. of Germany

[73] Assignee: Gewerkschaft Eisenhutte Westfalia, Lunen, Fed. Rep. of Germany

[21] Appl. No.: 127,716

[22] Filed: Mar. 6, 1980

[30] Foreign Application Priority Data

Mar. 7, 1979 [DE] Fed. Rep. of Germany ..... 2908827

[51] Int. Cl.[3] ..... E21C 35/12

[52] U.S. Cl. ..... 299/43; 299/34

[58] Field of Search ..... 299/32, 34, 43

[56] References Cited

U.S. PATENT DOCUMENTS

| | | | |
|---|---|---|---|
| 2,702,697 | 2/1955 | Lobbe | 299/34 |
| 3,306,664 | 2/1967 | Dommann et al. | 299/34 |
| 3,363,946 | 1/1968 | Willner et al. | 299/34 X |
| 4,067,619 | 1/1978 | Peters et al. | 299/43 |

*Primary Examiner*—Ernest R. Purser

*Attorney, Agent, or Firm*—Sughrue, Mion, Zinn, Macpeak & Seas

[57] ABSTRACT

A conveyor and guide assembly comprises a conveyor and a plough guide attached to one side of the conveyor. The conveyor comprises a plurality of conveyor sections joined end-to-end, and the guide comprises a plurality of guide sections positioned end-to-end. Each guide section is associated with, and extends substantially along, a corresponding conveyor section. The guide section has a generally L-shaped guide plate and a ramp-like cover plate which define therebetween upper and lower chain ducts for receiving a plough drive chain. Each section of the cover plate is curved over at the top towards the guide plate thereby delimiting the upper portion of the upper chain duct. Each adjacent pair of cover plate sections overlap in a first zone which extends over at least the curved-over portions thereof. Each pair of adjacent sections of the guide plate overlap in a second zone which adjoins said first zone. The gap between each pair of adjacent guide plate sections is longitudinally off-set from the corresponding gap between adjacent conveyor sections in a third zone which is adjacent to said second zone.

12 Claims, 3 Drawing Figures

31
36
37
I
34
33
32
17
p
21
21
c
17
40
41
I 1
p
15
III
II
16
35
34
36
37
26
19
a
5
b
2
13
18
40
c
F/G
14
9
II
12
11
4
III
7
21
3

6
28
27
30
s
25
19
23
22
24
25
30
29
27
E
D
19
26
26
19
17
17
8

CONVEYOR AND GUIDE ASSEMBLY

BACKGROUND OF THE INVENTION

This invention relates to a longwall conveyor and plough guide assembly.

A longwall conveyor, such as a scraper-chain conveyor, conventionally comprises a plurality of conveyor sections joined end-to-end. At its face side, the conveyor is provided with a guide for a winning plough, the guide comprising a plurality of guide sections positioned end-to-end. Each guide section is associated with, and extends substantially along, a corresponding one of the conveyor sections. The conveyor sections are joined together in such a manner as to permit limited articulation therebetween in any direction. Each guide section has a generally L-shaped guide plate and a ramp-like cover plate which define therebetween upper and lower chain ducts for the plough drive chain.

When using a conveyor and guide assembly of this type, there is a danger of small pieces of coal (or other mineral material) finding their way through gaps between adjacent guide sections and into the chain ducts. If this does occur, the free passage of the plough drive chain is not guaranteed, which can lead to jamming. The upper chain duct is particularly susceptible to this danger, especially where the mine working is inclined. Thus, in inclined workings, many of the guide sections are pulled away from one another because of their weight, so that the gaps therebetween increase in size, which naturally promotes the penetration of small pieces of coal. In this connection, the upper chain duct is again more susceptible, since the plough directs won coal in the zone of the upper chain duct. However, when the assembly is used in horizontal (or slightly inclined) workings, the upper chain duct is mainly exposed to the danger of blockage caused by small pieces of coal which force their way in through gaps on the goaf side of the assembly.

The aim of the invention is to provide a conveyor and guide assembly which does not suffer from the disadvantage of coal entry into the upper chain duct.

SUMMARY OF THE INVENTION

The present invention provides a conveyor and guide assembly comprising a conveyor and a plough guide attached to one side of the conveyor, the conveyor being constituted by a plurality of conveyor sections joined end-to-end, and the guide being constituted by a plurality of guide sections positioned end-to-end, each guide section being associated with, and extending substantially along, a corresponding conveyor section, the guide having a generally L-shaped guide plate and a ramp-like cover plate which define therebetween upper and lower chain ducts for receiving a plough drive chain, each cover plate section being curved over at the top towards the corresponding guide plate section thereby delimiting the upper portion of the upper chain duct, wherein each adjacent pair of cover plate sections overlap in a first zone which extends over at least the curved-over portions thereof, wherein each pair of adjacent guide plate sections overlap in a second zone which adjoins said first zone, and wherein the gap between each pair of adjacent guide plate sections is longitudinally off-set from the corresponding gap between adjacent conveyor sections in a third zone which is adjacent to said second zone.

With this type of assembly, the gaps between adjacent guide sections are closed off, at least in the region of the upper chain duct, against penetration by small pieces of coal from above as well as from the face and goaf sides. Moreover, this is accomplished without adversely affecting the fitting and removal of the guide sections. The off-setting of the gaps in said third zone prevents the entry of fine coal from the corresponding gap between the conveyor sections.

Advantageously, the guide plate sections of each adjacent pair engage one another, in the region of said third zone, by means of a tongue-and-groove connection. This ensures that the overlapping portions are not exposed to vertical forces applied between the guide sections which arise during winning. In this way, not only is damage to the overlapping portions avoided, but these portions can be of relatively small dimensions, which in turn means that the guide plate sections and the cover plate sections can be relatively thin.

Each cover plate section may be pivotally connected, at its lower end, to spacer means attached to the corresponding guide plate section, said spacer means separating the upper and lower chain ducts.

Preferably, each of the overlapping portions of the cover plate sections in said first zone is constituted by an extension projecting from an end of one of the cover plate sections, and a recessed portion formed in the adjacent end of the other cover plate section, the extension having a thickness which is substantially one half that of the end of said one cover plate section, and the recessed portion having a thickness which is substantially one half that of the end of said other cover plate section, and the extension engaging within the recessed portion with a small clearance therebetween. Advantageously, the cover plate sections of alternate guide sections are each provided with an extension at each end thereof, the cover plate sections of the other guide sections each being provided with a recessed portion at each end thereof. This enables each alternate cover plate section to be pivoted away from its guide plate section independently of the adjacent cover plate sections.

Conveniently, each of the cover plate sections has a central portion and two end portions welded to the central portion, the central portion having a thickness which is less than that of either of the end portions, and the end portions increasing in thickness towards their free ends. This enables the cover plate sections to be produced economically, not only because a considerable amount of material can be saved, but also because use can be made of prefabricated parts which can be produced cheaply as forgings or castings. Moreover, the cover plate sections have a lengthy service life, since those areas (their ends) which are subject to heavy wear, are suitably dimensioned to take up wear.

Advantageously, each of the overlapping portions of the guide plate sections in said second zone is constituted by an extension projecting from the upper edge of one of the guide plate sections, and a recessed portion formed in the adjacent upper edge of the other guide plate section, the extension having a thickness which is substantially half that of said one guide plate section, and the recessed portion having a thickness which is substantially half that of said other guide plate section, the extension engaging within the recessed portion with a small clearance therebetween. Preferably, the recessed portion of each guide plate section engages the top and side of the extension of the associated guide plate section. This improves the sealing off of the overlapping portions in this zone, since the gap between these overlapping portions opens up to one side of the guide plate.

Preferably, each of the tongue-and-groove connections in said third zone is formed by a rectangular tongue which projects from the end face of one guide plate section, and a correspondingly shaped recess formed in the other guide plate section, the tongue having the same thickness as that of said one guide plate section and engaging within the recess with a small clearance therebetween.

The invention also provides a plough guide for use with a longwall conveyor constituted by a plurality of conveyor sections joined end-to-end, the guide being constituted by a plurality of guide sections positioned end-to-end, each guide section being, in use, associated with, and extending substantially along, a corresponding conveyor section, the guide having a generally L-shaped guide plate and a ramp-like cover plate which define therebetween upper and lower chain ducts for receiving a plough drive chain, each cover plate section being curved over at the top towards the corresponding guide plate section thereby delimiting the upper portion of the upper chain duct, wherein each adjacent pair of cover plate sections overlap in a first zone which extends over at least the curved-over portions thereof, wherein each pair of adjacent guide plate sections overlap in a second zone which adjoins said first zone, and wherein the gap between each pair of adjacent guide plate sections is longitudinally off-set, in a third zone which is adjacent to said second zone, from the gap between that pair of adjacent guide plate sections in said second zone.

BRIEF DESCRIPTION OF THE DRAWINGS

A longwall conveyor and plough guide assembly constructed in accordance with the invention, will now be described, by way of example, with reference to the accompanying drawings, in which.

DESCRIPTION OF PREFERRED EMBODIMENT

Figure 1:
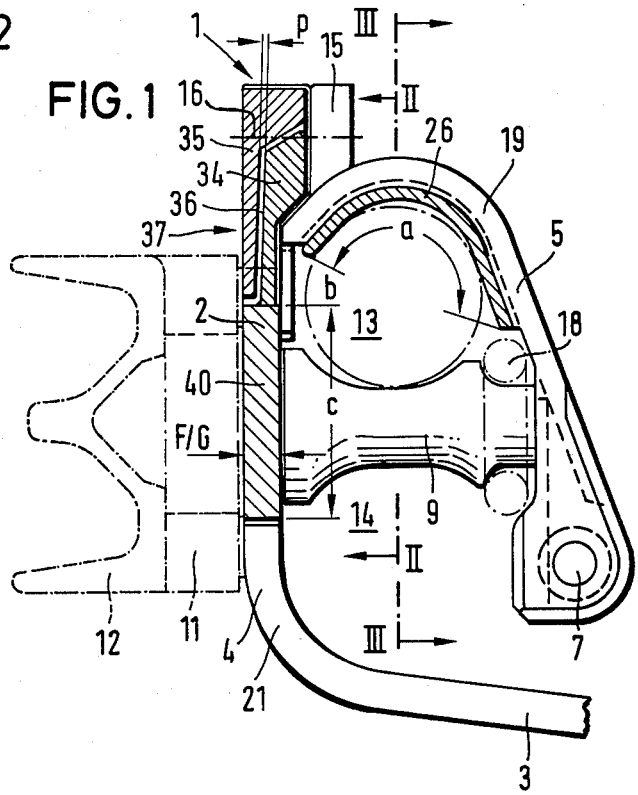
FIG. 1 is a cross-section taken on the line I—I of FIG. 2.
Figure 3:
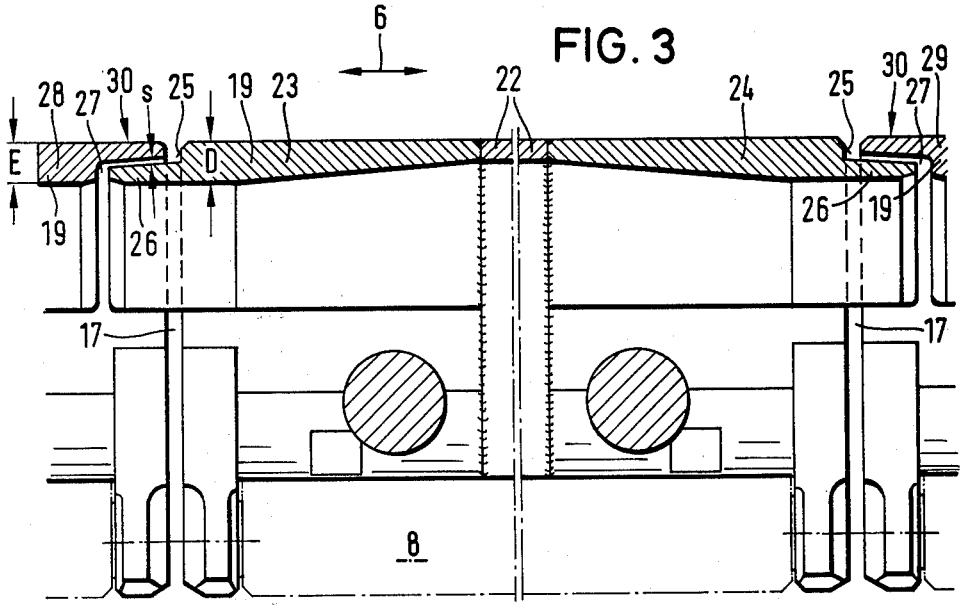
FIG. 3 is a cross-section taken on the line III—III of FIG. 1.

Referring to the drawings, FIG. 1 shows a plough guide, indicated generally by the reference numeral 1, which is constituted by a plurality of guide sections which correspond to, and are connected to, the sections of a scraper-chain conveyor 12. The guide has a generally L-shaped plate 4, and a ramp-like cover plate 5. The plate 4 has a vertical arm 2, which is fastened to the conveyor, and an arm 3 which is inclined downwardly and towards the work face (not shown). The arm 3 constitutes a floor plate and guide surface for the plough (not shown) which is movable to and fro along the guide 1. The cover plate 5 is pivotable about a shaft 7, which extends in the longitudinal direction of the longwall working (as indicated by the double-headed arrow 6 in FIG. 3), and is mounted on brackets 8 (see FIG. 3). Each of the brackets 8 is secured to sliding spacers 9, which are attached, by the plate 4 and intermediate members 11, to the face-side side plate of the conveyor 12.

The arm 2 and the cover plate 5 form between them two, vertically-spaced chain ducts 13 and 14 which house the two runs of the drive chain (not shown) of the plough. As best seen from FIG. 1, the upper edge of the cover plate 5 is curved over towards the corresponding arm 2 so as to delimit the top of the chain duct 13. This curved-over portion of the cover plate 5 is provided with an upstanding flange 15 by means of which the cover plate can be bolted to the arm 2 at 16.

A respective gap 17 is provided between each pair of adjacent sections of the guide 1, and the guide sections of each adjacent pair are interconnected by means of oval links 18 (see FIG. 1). Each link 18 embraces the adjacent spacers 9 on the opposite sides of a given gap 17, the link being accommodated in suitably-shaped recesses in the spacers, and being held in place by the cover plates 5 of the associated pair of guide sections. The links 18 are such as to permit limited articulation, in any direction, between adjacent guide sections.

The guide plate 4 is constituted by guide plate sections 21, and the cover plate 5 is constituted by cover plate sections 19, these sections 19 and 21 together forming the guide sections and corresponding to the sections of the conveyor 12. Each cover plate section 19 is of three-part construction, alternate sections having a central portion 22 of relatively thin metal, and two end portions 23 and 24 welded thereto. The end portions 23 and 24 increase in thickness towards their free ends (see FIG. 3), are die-forged or cast, and are made of a wear-resistant material. An extension 26 projects from the free end face 25 of each of the end portions 23 and 24. The other cover plate sections 19, which alternate with the first-mentioned sections, are also of three-part welded construction, each having a central portion (not shown but similar to the central portions 22) and two flared end portions 28 and 29. The extensions 26 have approximately half the thickness D of their end portions 23 and 24, and engage within recesses 27 in the end portions 28 and 29 of the adjacent end portions 28 and 29. The extensions 26 have a thickness which is approximately half the thickness E of the end portions 28 and 29, and engage within the recesses 27 with a small clearance S. The extensions 26 extend over the zone a (see FIG. 1) in which the curved-over portion of the cover plate 5 defines an upper and lateral limit for the chain duct 13. Together with the pockets 27, the extensions 26 form overlapping portions 30 which close off the gaps 17 in the zone a.

Figure 2:
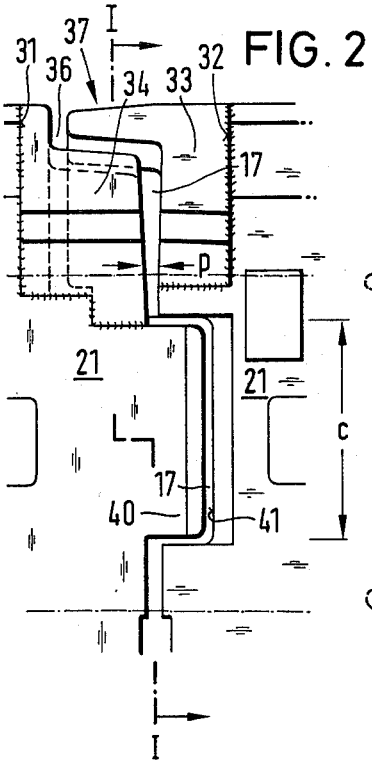
FIG. 2 is a side elevation of the adjacent ends of two adjacent sections of the guide, with their ramp-like cover plates swung away.

The adjacent corners of the adjacent guide plate sections 21 shown in FIGS. 1 and 2 are formed with recesses 31 and 32, into which are welded forged, shaped members 33 and 34 respectively. An extension 35 projects from the end face of the shaped members 33, the extension having a thickness which is approximately half the thickness F of the corresponding guide plate section 21. The extension 35 mates, with a small clearance p, with a recess 36 machined in the shaped member 34. The thickness of the recessed portion of the shaped member 34 is also approximately half the thickness G of the corresponding guide plate section 21. As can be seen from FIG. 1, the thickness F and G of the guide plate sections 21 are the same. Thus, the extension 35 and the recess 36 form overlapping portions 37 which close off the gap 17 in the zone b (see FIG. 1). Similar overlapping portions are formed between the adjacent upper corners of the other pairs of adjacent guide plate sections 21.

The adjacent guide plate sections 21 shown in FIGS. 1 and 2 are locked together by means of a locking flange 40 which extends from one of the guide plate sections to mate with a corresponding recess 41 machined in the other guide plate section. The locking flange 40 extends over a zone c (see FIG. 1), and locks the two guide plate sections 21 against relative movement in the vertical direction. Moreover, the gap 17 between the two guide plate sections 21 in the zone c is displaced longitudinally to the right (as seen in FIG. 2) with respect to the gap (not shown) between the corresponding sections of the conveyor. Similar locking flanges 40 and recesses 41 are provided between the adjacent ends of the other pairs of adjacent guide plate sections 21. Each recess 41 is slightly larger than its corresponding locking flange 40 so that the resultant clearance allows a predetermined amount of play. Thus, any fine coal escaping from the conveyor through the gaps between its sections will not fall upon the gaps 17 between the guide plate sections 21. Consequently, there is little chance of any such fine coal getting into chain duct 13. The provision of overlapping portions in the regions a and b, and the off-setting of the gaps 17 in the regions c results in the chain duct 13 being sealed off against the ingress of fine coal not only from above and from the face, but also from the goaf side.

We claim:

1. In a conveyor and guide assembly comprising a conveyor and a plough guide attached to one side of the conveyor, the conveyor comprising a plurality of conveyor sections joined end-to-end, and the guide comprising a plurality of guide sections positioned end-to-end, each guide section being associated with, and extending substantially along, a corresponding conveyor section, the guide having a generally L-shaped guide plate and a ramp-like cover plate which define therebetween upper and lower chain ducts for receiving a plough drive chain, each cover plate section being curved over at the top towards the corresponding guide plate section thereby delimiting the upper portion of the upper chain duct, the improvements comprising overlapping each adjacent pair of cover plate sections in a first zone which extends over at least the curved-over portions thereof, overlapping each pair of adjacent guide plate sections in a second zone which adjoins said first zone, and longitudinally off-setting the gap between each pair of adjacent guide plate sections from the corresponding gap between adjacent conveyor sections in a third zone which is adjacent to said second zone.

2. A conveyor and guide assembly comprising a conveyor and a plough guide attached to one side of the conveyor, the conveyor comprising a plurality of conveyor sections joined end-to-end, and the guide comprising a plurality of guide sections positioned end-to-end, each guide section being associated with, and extending substantially along, a corresponding conveyor section, the guide having a generally L-shaped guide plate and a ramp-like cover plate which define therebetween upper and lower chain ducts for receiving a plough drive chain, the cover plate being curved over at the top towards the guide plate thereby delimiting the upper portion of the upper chain duct, wherein each adjacent pair of cover plate sections overlap in a first zone which extends over at least the curved-over portions thereof, wherein each pair of adjacent guide plate sections overlap in a second zone which adjoins said first zone, and wherein the gap between each pair of adjacent guide plate sections is longitudinally off-set from the corresponding gap between adjacent conveyor sections in a third zone which is adjacent to said second zone.

3. An assembly according to claim 2, wherein the guide plate sections of each adjacent pair engage one another, in the region of said third zone, by means of a tongue-and-groove connection.

4. An assembly according to claim 3, wherein each of the tongue-and-groove connections in said third zone is formed by a rectangular tongue which projects from the end face of one guide plate section, and a correspondingly shaped recess formed in the other guide plate section, the tongue having the same thickness as that of said one guide plate section and engaging within the recess with a small clearance therebetween.

5. An assembly according to claim 2, wherein each cover plate section is pivotally connected, at its lower end, to spacer means attached to the corresponding guide plate section, said spacer means separating the upper and lower chain ducts.

6. An assembly according to claim 2, wherein each of the overlapping portions of the cover plate sections in said first zone includes an extension projecting from an end of one of the cover plate sections, and a recessed portion formed in the adjacent end of the other cover plate section, the extension having a thickness which is substantially one half that of the end of said one cover plate section, and the recessed portion having a thickness which is substantially one half that of the end of said other cover plate section, and the extension engaging within the recessed portion with a small clearance therebetween.

7. An assembly according to claim 6, wherein the cover plate sections of alternate guide sections are each provided with an extension at each end thereof, the cover plate sections of the other guide sections each being provided with a recessed portion at each end thereof.

8. An assembly according to claim 2, wherein each of the cover plate sections has a central portion and two end portions welded to the central portion, the central portion having a thickness which is less than that of either of the end portions, and the end portions increasing in thickness towards their free ends.

9. An assembly according to claim 2, wherein each of the overlapping portions of the guide plate sections in said second zone includes an extension projecting from the upper edge of one of the guide plate sections, and a recessed portion formed in the adjacent upper edge of the other guide plate section, the extension having a thickness which is substantially half that of said one guide plate section, and the recessed portion having a thickness which is substantially half that of said other guide plate section, the extension engaging within the recessed portion with a small clearance therebetween.

10. An assembly according to claim 9, wherein the recessed portion of each guide plate section engages the top and side of the extension of the associated guide plate section.

11. An assembly according to claim 2, wherein the conveyor sections are joined together in such a manner as to permit limited articulation therebetween in any direction.

12. A plough guide for use with a longwall conveyor comprising a plurality of conveyor sections joined end-to-end, the guide comprising a plurality of guide sections positioned end-to-end, each guide section being associated with, and extending substantially along, a corresponding conveyor section, the guide having a generally L-shaped guide plate and a ramp-like cover plate which define therebetween upper and lower chain ducts for receiving a plough drive chain, each cover plate section being curved over at the top towards the corresponding guide plate section thereby delimiting the upper portion of the upper chain duct, wherein each adjacent pair of cover plate sections overlap in a first zone which extends over at least the curved-over portions thereof, wherein each pair of adjacent guide plate sections overlap in a second zone which adjoins said first zone, and wherein the gap between each pair of adjacent guide plate sections is longitudinally off-set, in a third zone which is adjacent to said second zone, from the gap between that pair of adjacent guide plate sections in said second zone.

* * * * *